US012486077B2

(12) United States Patent
Donner et al.

(10) Patent No.: US 12,486,077 B2
(45) Date of Patent: Dec. 2, 2025

(54) PLASTIC FILM BAG, SUCH AS A TAMPER-PROOF PLASTIC FILM BAG, BLANK FOR A PLASTIC FILM BAG AND USE OF THE PLASTIC FILM BAG AS TRANSPORT AND/OR PACKAGING CONTAINER

(71) Applicant: Mettler Packaging LLC, Raynham, MA (US)

(72) Inventors: Rene Donner, Morbach (DE); Patrick Eberhard, Morbach-Hundheim (DE)

(73) Assignee: Mettler Packaging LLC, Raynham, MA (US)

( * ) Notice: Subject to any disclaimer, the term of this patent is extended or adjusted under 35 U.S.C. 154(b) by 49 days.

(21) Appl. No.: 18/454,667

(22) Filed: Aug. 23, 2023

(65) Prior Publication Data

US 2024/0067410 A1 Feb. 29, 2024

(30) Foreign Application Priority Data

Aug. 24, 2022 (EP) ..... 22191983

(51) Int. Cl.
*B65D 33/18* (2006.01)
*B65D 33/08* (2006.01)

(52) U.S. Cl.
CPC ..... *B65D 33/18* (2013.01); *B65D 33/08* (2013.01); *B65D 2401/00* (2020.05)

(58) Field of Classification Search
CPC ..... B65D 33/18; B65D 33/08; B65D 2401/00
USPC ..... 383/211, 5, 10, 66
See application file for complete search history.

(56) References Cited

U.S. PATENT DOCUMENTS 5,044,772 A * 9/1991 Larson ..... B65D 33/14 229/80
2011/0182531 A1 7/2011 Steele

FOREIGN PATENT DOCUMENTS

| | | | |
|---|---|---|---|
| CN | 111348316 A | * | 6/2020 |
| FR | 2 908 112 A1 | | 5/2008 |
| GB | 2 193 484 A | | 2/1988 |
| GB | 2 315 730 A | | 2/1998 |
| JP | H1129155 A | * | 2/1999 |

OTHER PUBLICATIONS

European Search Report for EP Application No. 22191983.0 dated Feb. 16, 2023, 7 pages.

* cited by examiner

*Primary Examiner* — Jes F Pascua
(74) *Attorney, Agent, or Firm* — Seed Intellectual Property Law Group LLP

(57) ABSTRACT

A plastic film bag with a bag opening with a bag opening edge, spaced apart from the upper edge of the bag, a connecting area interconnecting the plastic film front wall and the plastic film rear wall between the upper edges thereof and the bag opening edge, and (i) a first adhesion area which extends below the connecting area on the inner face of the plastic film rear wall from the first side edge of the plastic film rear wall up to the second side edge of the plastic film rear wall, or (ii) a second adhesive area which extends below the bag opening edge on the inner face of the plastic film front wall from the first side edge of the plastic film front wall up to the second side edge of the plastic film front wall. Furthermore, the present disclosure describes a blank for the plastic film bag.

14 Claims, 7 Drawing Sheets

PLASTIC FILM BAG, SUCH AS A TAMPER-PROOF PLASTIC FILM BAG, BLANK FOR A PLASTIC FILM BAG AND USE OF THE PLASTIC FILM BAG AS TRANSPORT AND/OR PACKAGING CONTAINER

BACKGROUND

Technical Field

The present disclosure relates to a plastic film bag, in some cases a tamper-proof plastic film bag, e.g., a duty-free plastic film bag. The present disclosure further relates to a blank for a plastic film bag. Finally, the present disclosure relates to the use of the plastic film bags according to the present disclosure as transport and/or packaging container, in some cases in the duty-free area.

Description of Related Art

Plastic film bags are generally common ready-to-use transport or packaging containers which are used for a variety of purposes. In order to keep the costs of material low, for example, the thickness of the plastic films has been reduced over time. Conventional plastic carrier bags, as are known from supermarkets, generally have a film thickness in the range of about 60 μm. An even more extensive reduction in the thickness of the plastic films used is generally limited by the associated reduced tear strength. Despite the low thicknesses of the films for plastic film bags, these are usually coextruded film systems. The individual layers used here are often used either to ensure the printability or to adjust the elastic or mechanical property profile to the respective intended use.

For plastic film bags which are intended to be used as transport or packaging container in the duty-free area of, for example, airports, in addition to the tear strength, it is often of particular interest that manipulation of the contents can be ruled out after filling with the duty-free article. Like many other sales containers, plastic film bags for the duty-free area are also always manufactured in large numbers. If production interruptions are to be avoided, for example as a result of a product jam at the level of intermediate products, particular care is often required when carrying out the process.

Thus, there is accordingly a need to provide a plastic film bag which is not affected by the disadvantages of the prior art and which, in some cases in a material-saving manner, makes fully functional plastic film bags, e.g., for the duty-free area, accessible in a simple manner in terms of apparatus and production technology, but nevertheless in a reliable manner, in some cases also in automated mechanical mass production.

BRIEF SUMMARY

Accordingly, a plastic film bag has been found, comprising a plastic film front wall having an inner face and an outer face and having a first side edge and an opposite second side edge and also an upper edge and an opposite lower edge and having a bag opening spaced apart from the upper edge with a bag opening edge which extends from or spaced apart from the first side edge of the plastic film front wall as far as or in the direction of the second side edge of the plastic film front wall, a plastic film rear wall having an inner face and an outer face and having a first side edge and an opposite second side edge as well as an upper edge and an opposite lower edge, and a bag bottom, wherein the plastic film front wall and the plastic film rear wall are connected to one another between their upper edges and the bag opening edge via at least one connecting area which extends from or spaced apart from the first side edges of plastic film front wall and plastic film rear wall as far as or in the direction of the second side edges of plastic film front wall and plastic film rear wall, and further comprising at least one first adhesive area which extends below the connecting area, and in some cases adjacent to the connecting area, on the inner face of the plastic film rear wall from or spaced apart from the first side edge of the plastic film rear wall as far as or in the direction of the second side edge of the plastic film rear wall and which has a width (A) transverse to this extension or at least one second adhesive area which extends below the bag opening edge, and in some cases adjacent to the bag opening edge, on the inner face of the plastic film front wall from or spaced apart from the first side edge of the plastic film front wall as far as or in the direction of the second side edge of the plastic film front wall and which has a width (B) transverse to this extension, wherein the plastic film front wall and the plastic film rear wall merge into one another, in some cases in one piece, at their respective first side edges in that section which lies below the first or second adhesive area, or wherein the plastic film front wall and the plastic film rear wall in the region of their first side edges are present bonded or welded to one another, in that section which lies below the first or second adhesive area, and wherein the plastic film front wall and the plastic film rear wall at their respective second side edges merge into one another, in some cases in one piece, in that section which lies below the first or second adhesive area, or wherein the plastic film front wall and the plastic film rear wall in the region of their second side edges are present bonded or welded to one another, in that section which lies below the first or second adhesive area.

BRIEF DESCRIPTION OF THE SEVERAL VIEWS OF THE DRAWINGS

Further features and advantages of the present disclosure emerge from the following description in which exemplary embodiments of the present disclosure are explained by means of example with reference to schematic drawings, without thereby restricting the present disclosure.

In the drawings.

DETAILED DESCRIPTION

Figure 1:
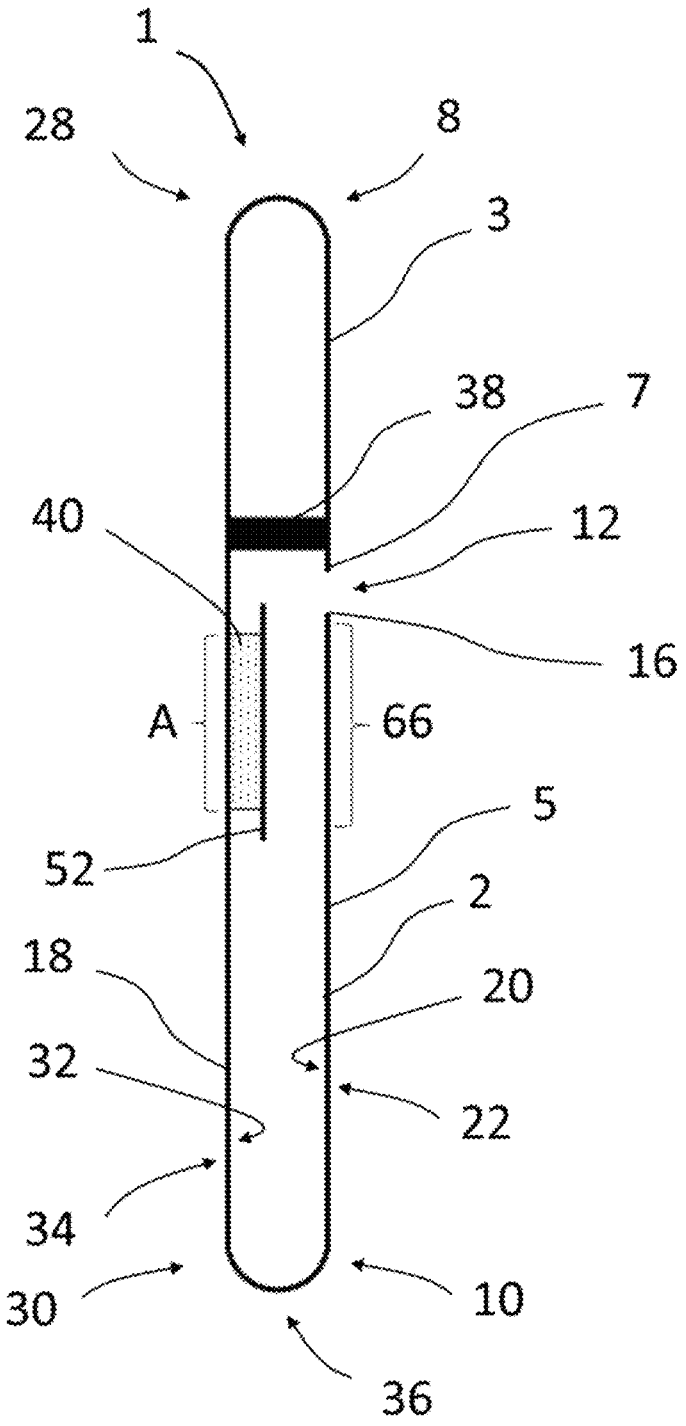
FIG. 1 shows a first embodiment of a plastic film bag according to the present disclosure in a lateral sectional view.

Insofar as terms such as "lower," "upper," "below," and "above" are used in connection with the plastic film bag according to the present disclosure, reference is made here to a bag which is expediently carried with the aid of grip holes or loops in the case of generic use.

In an expedient embodiment of the plastic film bag according to the present disclosure, it can be provided that the upper edge of the plastic film front wall and the upper edge of the plastic film rear wall form the transition from the plastic film front wall to the plastic film rear wall by means of bonding or welding or that the plastic film front wall and the plastic film rear wall merge into one another in one piece at their respective upper edges, and/or that the lower edge of the plastic film front wall and the lower edge of the plastic film rear wall in the region of the bag bottom form the transition from the plastic film front wall to the plastic film rear wall by means of bonding or welding or in that the plastic film front wall and the plastic film rear wall merge into one another in one piece at their respective lower edges.

Plastic film bags are advantageously used in which the plastic film front wall and the plastic film rear wall merge into one another, in some cases in one piece, at their respective upper edges and in which the plastic film front wall and the plastic film rear wall merge into one another, in some cases in one piece, at their respective lower edges.

In an expedient embodiment of the plastic film bag according to the present disclosure, it is provided that the plastic film front wall and the plastic film rear wall merge into one another in one piece at their respective upper edges, that the plastic film front wall and the plastic film rear wall merge into one another in one piece at their respective lower edges, that the plastic film front wall and the plastic film rear wall in the region of their first side edges are present bonded or welded to one another in that section which lies below the first or second adhesive area, and that the plastic film front wall and the plastic film rear wall in the region of their second side edges are present bonded or welded to one another in that section which lies below the first or second adhesive area.

The transition, such as the one-piece transition, from plastic film front wall to plastic film rear wall in the plastic film bags according to the present disclosure is in some cases formed as a fold or crease in the region of their upper edges. Alternatively or additionally, it can be provided that the transition, such as the one-piece transition, from plastic film front wall to plastic film rear wall in the region of their lower edges is likewise formed as a fold or crease. This transition formed as a fold or crease then also forms the bag bottom or is a constituent part thereof.

The present disclosure further describes plastic film bags according to the present disclosure in which the plastic film front wall and the plastic film rear wall merge into one another in one piece at their respective first side edges in that section which lies below the first or second adhesive area, and in which the plastic film front wall and the plastic film rear wall in the region of their second side edges are present welded to one another in that section which lies below the first or second adhesive area. Alternatively, from the point of view of production technology aspects, it can be provided in an expedient embodiment that the plastic film front wall and the plastic film rear wall in the region of their first side edges are present welded to one another in that section which lies below the first or second adhesive area, and that the plastic film front wall and the plastic film rear wall in the region of their second side edges are present welded to one another in that section which lies below the first or second adhesive area. In the embodiments described above, the transition from plastic film front wall to plastic film rear wall in the region of their first side edges, if they are not present welded to one another, is in some cases formed as a fold or crease.

Such plastic film bags are in some cases also used in which the plastic film front wall and the plastic film rear wall in the region of their first side edges are present welded to one another in that section which lies below the first or second adhesive area, and in which, furthermore, the plastic film front wall and the plastic film rear wall in the region of their second side edges are present welded to one another in that section which lies below the first or second adhesive area. Hereby such embodiments are suitable, in which the plastic film front wall and the plastic film rear wall additionally merge into one another, in some cases in one piece, at their respective upper edges and in which the plastic film front wall and the plastic film rear wall merge into one another, in some cases in one piece, at their respective lower edges.

The plastic film bags according to the present disclosure are distinguished in expedient embodiments in some cases also in that the plastic film front wall and the plastic film rear wall do not merge into one another or are not connected to one another at their respective first side edges in that section which lies in the region of the first or second adhesive area and extends as far as the bag opening edge, and in that the plastic film front wall and the plastic film rear wall do not merge into one another or are not connected to one another at their respective second side edges in that section which lies in the region of the first or second adhesive area and extends as far as the bag opening edge. Hereby the plastic film front wall in the region from the bag opening edge in the direction of the bag bottom, in which the first and second side edges of the plastic film front wall are not connected to the first and second side edges of the plastic film rear wall or do not merge into one another, in some cases forms a fold-over closure flap with a width (C). The width (C) in this case represents the extension of the fold-over closure flap transverse to the extension between the first and second side edges of plastic film front wall and plastic film rear wall from the bag opening edge in the direction of the bag bottom.

The present disclosure further describes such plastic film bags in which the second adhesive area is present in the region of the fold-over closure flap or in which the first adhesive area is present on the inner face of the plastic film rear wall in a region which can be brought into coverage with the fold-over closure flap. Expediently, the width (A) of the first adhesive area or the width (B) of the second adhesive area is in this case generally smaller than or equal to the width (C) of the fold-over closure flap.

For many applications, it has proven expedient, that the at least one connecting area of the plastic film bags according to the present disclosure is a weld seam, such as a thermoplastic weld seam, which extends from the first side edges of plastic film front wall and plastic film rear wall as far as the second side edges of plastic film front wall and plastic film rear wall and which in some cases runs substantially parallel or even parallel to the bag opening edge. In this way, the upper portion of the bag, into which e.g., grip holes can be incorporated, is reliably and securely separated from the lower bag portion which has the bag opening and which is provided for receiving objects. Although the plastic film bag according to the present disclosure manages with a very low use of material, a very stable and at the same time tamper-proof transport and packaging container is already obtained in this way.

Hereby, in expedient embodiments, it can be provided that the at least one connecting area, such as the weld seam, in some cases thermoplastic weld seam, is present spaced closer apart from the bag opening edge than from the upper edge of the plastic film front wall, in some cases adjacent to the bag opening edge. If the weld seam, such as the thermoplastic weld seam, is present adjacent to the bag opening edge, this weld seam is pragmatically not located in coverage with the bag opening edge; rather, it is then in some cases still present at a slight spacing.

In a further expedient embodiment, it is provided that the at least one first or second adhesive area is arranged below the bag opening edge, in some cases adjacent to the bag opening edge. Hereby the film section of the front wall, which ends with the bag opening edge, lies flat on the likewise flat rear wall on the inner face thereof.

For the generic use of the plastic film bag according to the present disclosure, the co-use of at least one adhesive cover, configured and adapted for temporarily covering the first or second adhesive area, has proven expedient. Such removable protective covers, which prevent the early bonding of the adhesive area, are known to the person skilled in the art.

For the purpose of simplifying the transport of the plastic film bags according to the present disclosure, it can be provided that the plastic film front wall and the plastic film rear wall each have at least one substantially congruent or even congruent, grip hole in the section between the connecting area and the upper edges of plastic film front wall and plastic film rear wall.

The plastic film front wall and/or plastic film rear wall of the plastic film bag can be manufactured, for example, from a single-layer or multi-layer film material or comprise such a material. In many cases, the use of a single-layer film material is sufficient.

Hereby, polyolefins such as polyethylene and/or polypropylene and in some cases HD polyethylene, are used in some cases for the film material of plastic film front wall and/or the plastic film rear wall.

The film material of plastic film front wall and/or plastic film rear wall can also be configured transparent in one embodiment.

It is further advantageous that plastic film bags according to the present disclosure are accessible in which the plastic film front wall, the bag bottom, are present, for example, as a fold or crease, and the plastic film rear wall are formed in one piece.

Plastic film bags according to the present disclosure can further be equipped with at least one carrying element, in some cases in the form of a holding loop or a holding grip.

The present disclosure further describes a blank for a plastic film bag according to the present disclosure made of a single-layer or multi-layer plastic film with a first plastic film front wall section, in some cases containing a grip hole, a plastic film rear wall section adjoining this, in some cases in one piece, and in some other cases containing a grip hole, and a second plastic film front wall section adjoining this, in some cases in one piece, containing a bag opening edge, wherein the length of the plastic film rear wall section is greater than or equal to the cumulative length of the first plastic film front wall section and the second plastic film front wall section.

The plastic film bags according to the present disclosure are also suitable as, in some cases tamper-proof, transport and/or packaging container, such as in the duty-free area or as carrying bag for fruit or vegetables.

The present disclosure is accompanied by the surprising finding that plastic film bags are accessible in a very material-saving manner and nevertheless provide a reliable transport and/or packaging container which can even be used as tamper-proof transport and/or packaging container, e.g., for the duty-free area, or also as a fruit or vegetable carrying bag.

FIG. 1 shows a first embodiment of a plastic film bag 1 according to the present disclosure in a lateral sectional view with a plastic film front wall 2, containing an inner face and an outer face 20, 22, having an upper edge and an opposite lower edge 8, 10 and a plastic film rear wall 18, containing an inner face and an outer face 32, 34, having an upper edge and an opposite lower edge 28, 30. While the plastic film rear wall 18 is formed continuously, the bag opening 12 is present in the plastic film front wall 2. In contrast to conventional plastic carrier bags, the bag opening 12 is not arranged at the top at the upper end of the bag but is located in the upper half of the plastic film front wall 2 in the embodiment shown. The plastic film front wall 2 can be obtained, for example, by folding over a first film area 3 in the region which forms the upper edge 8 of the plastic film bag as well as by folding over a second film area 5 in the region which forms the lower edge 36 of the plastic film bag. The bag opening 12 is accordingly present spaced apart from the upper edge 8. The upper end of the second film area 5 hereby forms the bag opening edge 16. The lower end 7 of the first film area 3 is located above, in some cases adjacent to, the bag opening edge 16. The plastic film front wall 2 and the plastic film rear wall 18 are connected to one another in the region of their lower edges 10, 30 and form the bag bottom 36 there. In the embodiment shown, the plastic film front wall 2 and the plastic film rear wall 18 merge into one another in one piece in this region. According to the first embodiment of the plastic film bag 1 according to the present disclosure, the plastic film front wall 2 and the plastic film rear wall 18 are connected to one another between their upper edges 8, 28 and the bag opening edge 16 via a connecting area 38 in the form of a weld seam. Hereby, the weld seam is advantageously located in the lower region of the first film area 3 and thus adjacent to the bag opening 12. This weld seam (not shown) generally extends from the first side edges 4, 24 of the plastic film front wall 2 and the plastic film rear wall 18 as far as the second side edges 6, 26 of plastic film front wall 2 and plastic film rear wall 18. In the embodiment shown, a first adhesive area 40 is present on the inner face 32 of the plastic film rear wall 18. This adhesive area is located below and adjacent to the weld seam 38 and is temporarily covered with a protective film 52. After the protective film 52 has been removed, the corresponding section of the inner face 20 can be connected to the first adhesive area 40, closing the film bag. The adhesive area 40 has a width (A). In the present case, the width (A) is to be understood as an extension in the direction from the upper edge 28 to the lower edge 30. At the first and second side edges 4, 6, 24, 26, the plastic film front wall 2 and the plastic film rear wall 18 are connected to one another or merge into one another up to or just below the first adhesive area 40. In this way, the upper section of the second area 5 of the plastic film front wall 2 remains unconnected to the plastic film rear wall 18 and forms a so-called fold-over closure flap 66.

Figure 2:
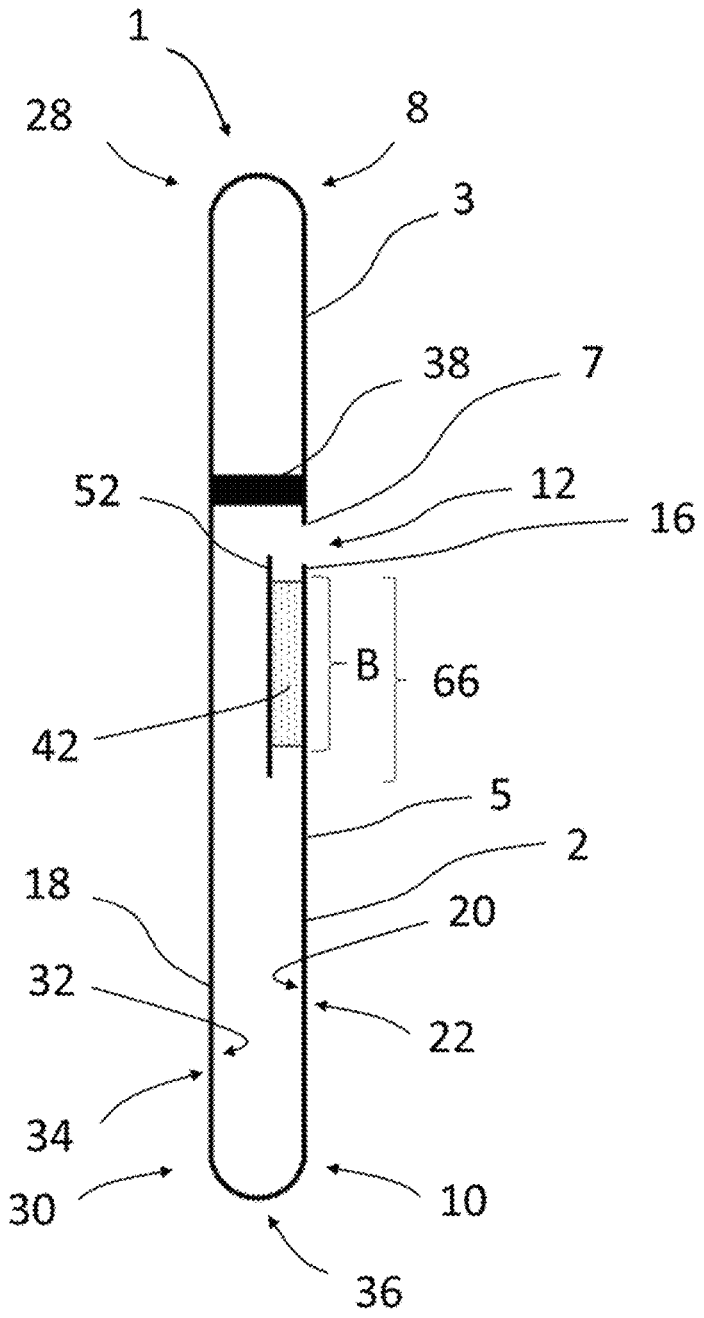
FIG. 2 shows a second embodiment of a plastic film bag according to the present disclosure in a lateral sectional view.

The second embodiment of a plastic film bag 1 according to the present disclosure, as shown in FIG. 2, differs from the first embodiment according to FIG. 1 in that the adhesive area, in the present case called second adhesive area 42, is not present on the inner face 32 of the plastic film rear wall 18, but on the inner face 20 of the plastic film front wall 2. This second adhesive area 42 is located below the bag opening edge 16, namely adjacent to this bag opening edge 16. Again, by removing the protective film 52, an adhesive connection to the inner face 32 of the plastic film rear wall 18 can be caused, as a result of which the bag is closed. The adhesive area 42 has a width (B). In the present case, the width (B) is to be understood as an extension in the direction from the upper edge 8 to the lower edge 10.

Figure 3:
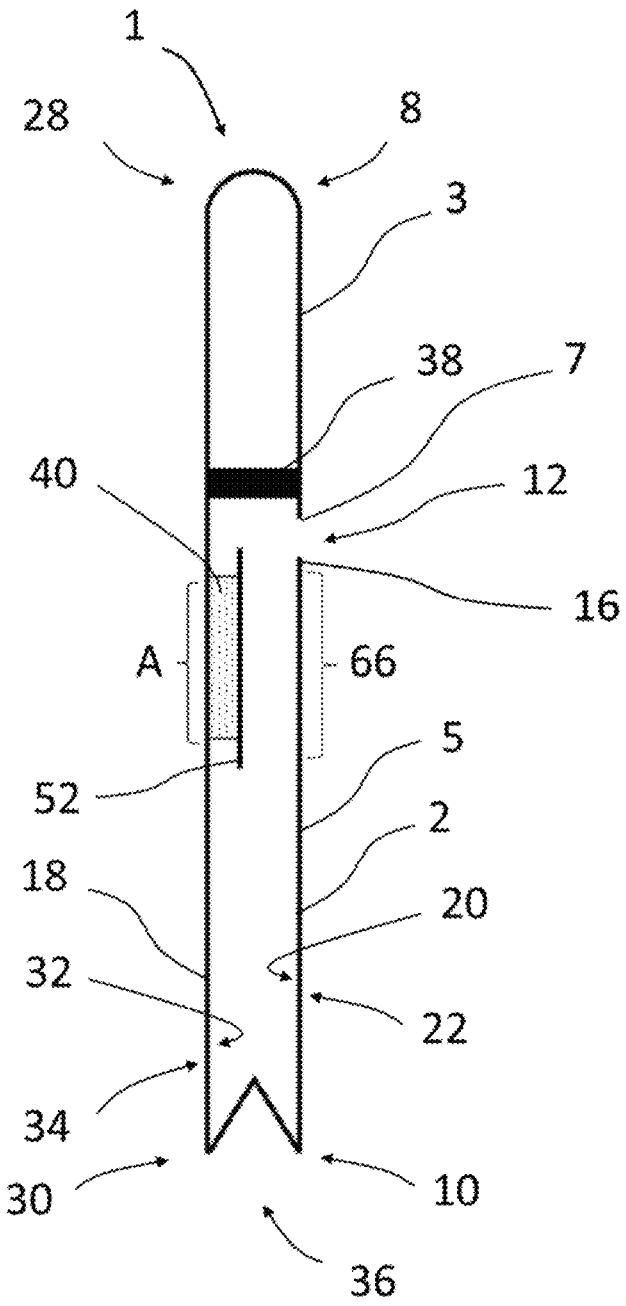
FIG. 3 shows a third embodiment of a plastic film bag according to the present disclosure in a lateral sectional view.

The embodiment of a plastic film bag according to the present disclosure according to FIG. 3 differs from the embodiment according to FIG. 1 only in that the bag bottom 36 is formed as a bottom with a bottom fold.

Figure 4:
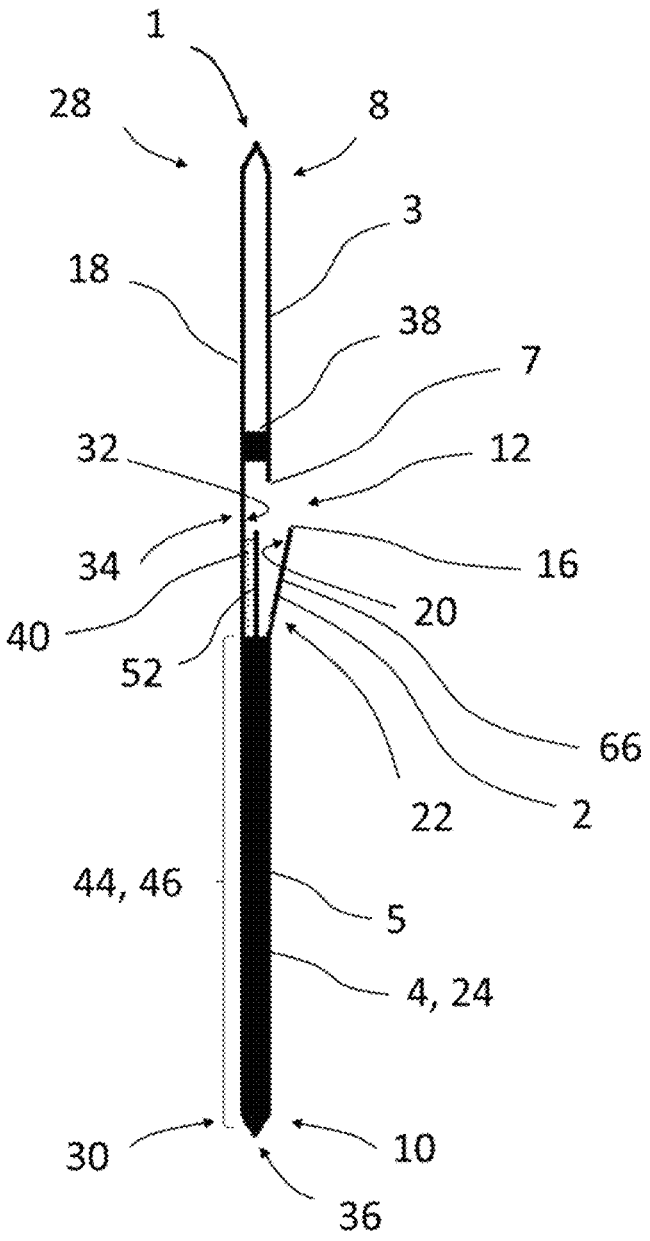
FIG. 4 shows a schematic side view of the first embodiment of the plastic film bag according to the present disclosure.

FIG. 4 shows the embodiment of a plastic film bag 1 according to the present disclosure, as shown in FIG. 1, in a schematic side view. In this embodiment, the plastic film front wall 2 and the plastic film rear wall 18 in the region of the first side edges 4, 24 are present welded to one another in that section 44, 46 which lies below the first adhesive area 40. In this embodiment (not shown), the plastic film front wall 2 and the plastic film rear wall 18 likewise in the region of the second side edges 6, 26 are present welded to one another in that section 48, 50 which lies below the first adhesive area 40. Thus, the upper section of the second area 5 of the plastic film front wall 2 remains unconnected to the plastic film rear wall 18 and forms the fold-over closure flap 66.

Figure 5:
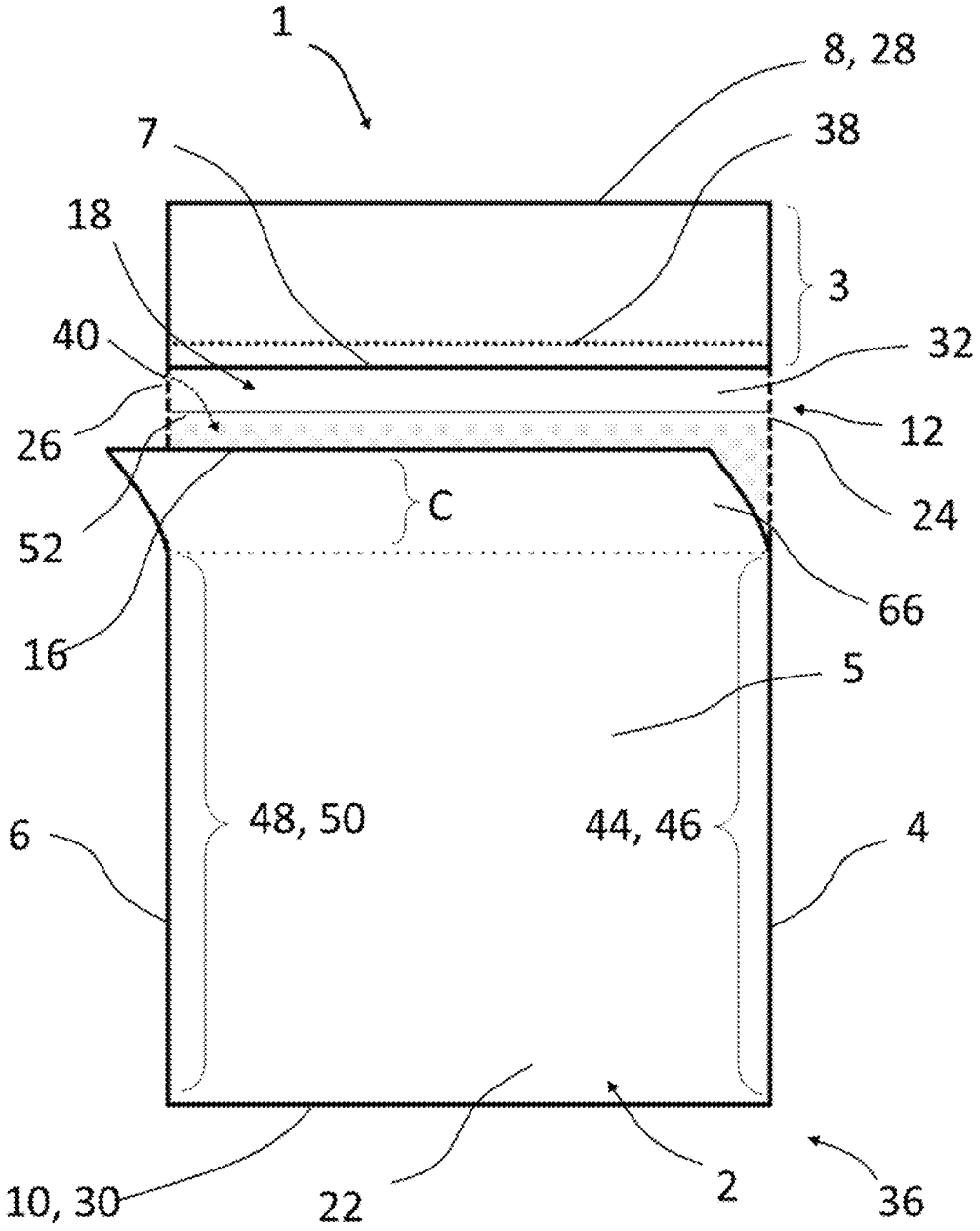
FIG. 5 shows a schematic perspective view of a fourth embodiment of the plastic film bag according to the present disclosure.

The fourth embodiment of the plastic film bag according to the present disclosure shown in FIG. 5 in a perspective view substantially corresponds to the embodiment shown in FIGS. 1 and 4. The only difference is that the plastic film front wall 2 and the plastic film rear wall 18 are present welded to one another not only in the region of the first side edges 4, 6, 24, 26 in those sections 44, 46, 48, 50 which lie below the first adhesive area 40, but likewise in the region of the first film area 3 of the plastic film front wall 2. Of course, the embodiments of FIGS. 1 to 4 can also be formed in such a way that the plastic film front wall 2 and the plastic film rear wall 18 are present welded to one another not only in the region of the first side edges 4, 6, 24, 26 in those sections 44, 46, 48, 50 which lie below the first adhesive area 40, but likewise in the region of the first film area 3 of the plastic film front wall 2. These embodiments are useful. They provide an even higher degree of stability and carrying comfort. By folding over the fold-over closure flap 66 outwards along the dashed line, the opening of the plastic film bag can be increased again. This is very expedient for the filling process. The fold-over closure flap 66 has a width (C) which in the embodiment shown substantially corresponds to the width (A) of the adhesive area 40. In the embodiment shown, the bag opening 12 extends from the first side edge 4 of the plastic film front wall 2 as far as the second side edge 6 of the plastic film front wall 2. In the embodiment shown, the connecting area 38 in the form of a weld seam further likewise extends from the first side edges 4, 24 of the plastic film front wall 2 and the plastic film rear wall 18 as far as the second side edges 6, 26 of the plastic film front wall 2 and the plastic film rear wall 18. Finally, in the embodiment shown, the adhesive area 40 extends from the first side edge 24 of the plastic film rear wall 18 as far as the second side edge 26 of the plastic film rear wall 18.

Figure 6:
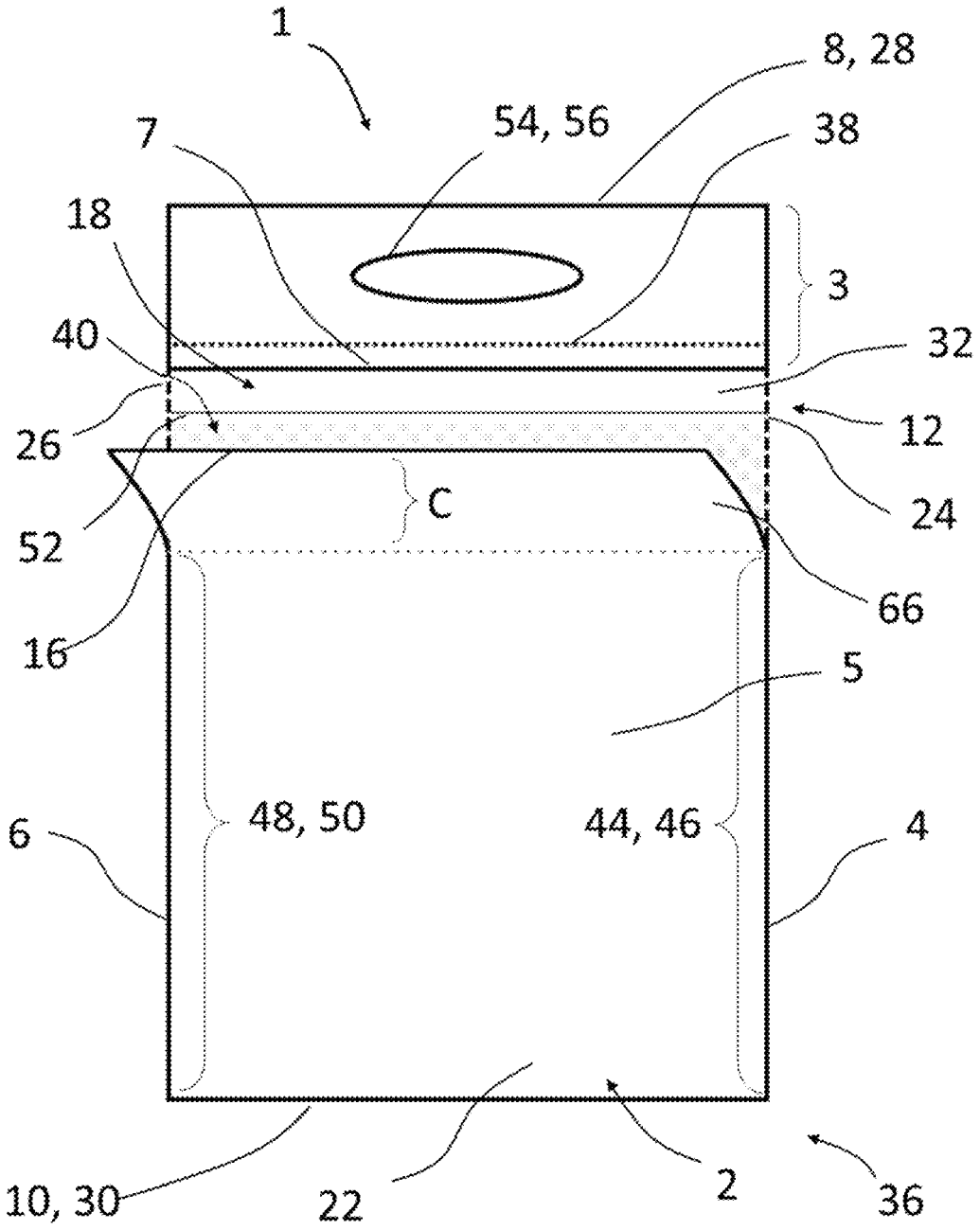
FIG. 6 shows a schematic perspective view of a fifth embodiment of the plastic film bag according to the present disclosure.

The plastic film bag 1 according to FIG. 6 differs from the embodiment according to FIG. 5 only in that congruent grip holes 54, 56 are provided in the plastic film front wall 2 and the plastic film rear wall 18 in the region between the weld seam 38 and the upper edges 8, 28. This type of attachment of grip holes permits very secure transport even of heavy filling goods.

Figure 7:
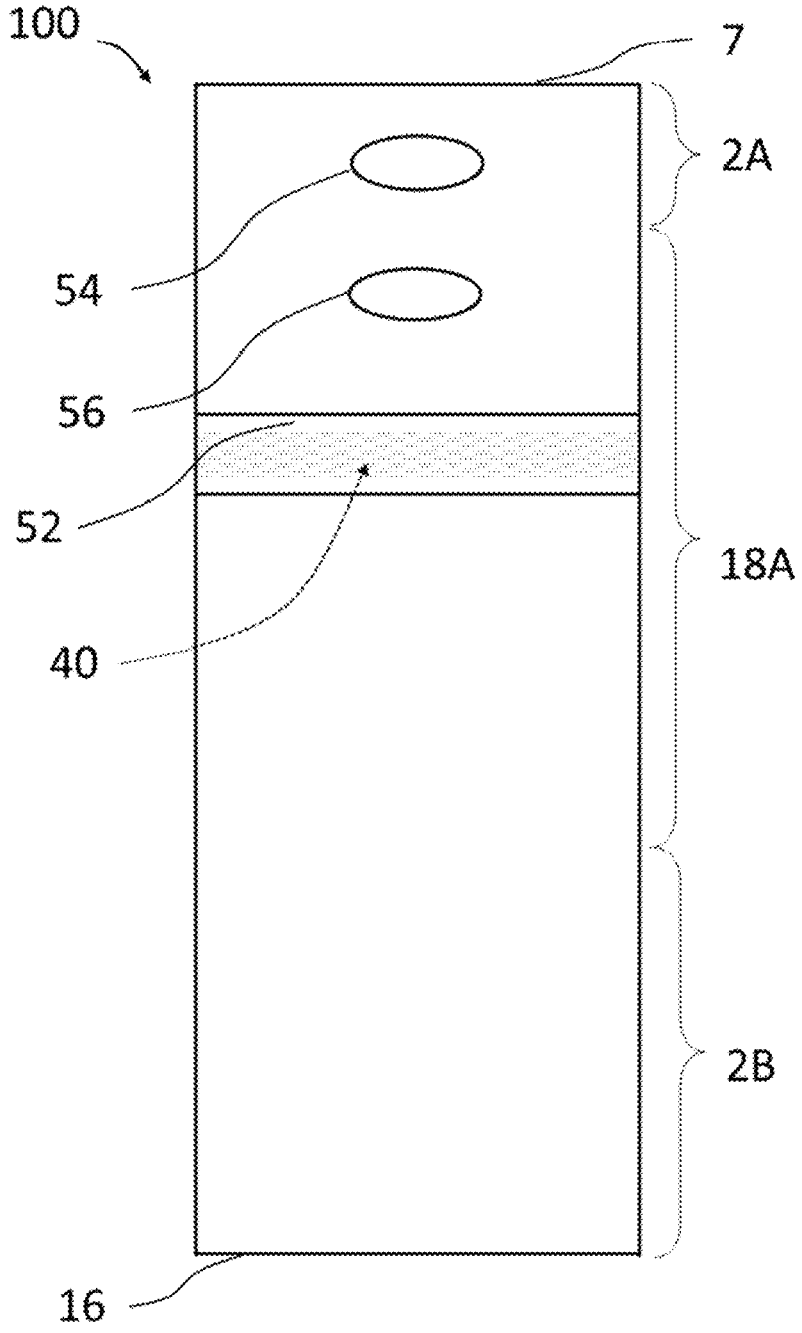
FIG. 7 shows a schematic view of a blank according to the present disclosure for a plastic film bag according to the present disclosure.

FIG. 7 shows a schematic view of a blank according to the present disclosure for a plastic film bag according to the present disclosure according to the embodiment, as shown in FIG. 6, formed from a single-layer plastic film. This blank 100 contains a first plastic film front wall section 2A equipped with a grip hole 54, which forms the first film area 3 of the plastic film front wall in the plastic film bag. Accordingly, the upper edge of the blank 100 represents the lower end 7 of the film area 3. The plastic film rear wall section 18A, which is likewise equipped with a grip hole 56, adjoins this section without transition, i.e., in one piece. A first adhesive area 40, which extends from a first side edge to the opposite second side edge, is located on the inner face of the blank 100 in the area of the plastic film rear wall section 18A, and is in some cases also already covered with a protective film 52. In the embodiment shown, a second plastic film front wall section 2B adjoins the section 18A without transition. Its lower edge forms the bag opening edge 16 of the second film area 5 in the finished plastic film bag according to the present disclosure. In the embodiment shown, the length of the plastic film rear wall section 18A is slightly greater than the cumulative length of the first plastic film front wall section 2A and the second plastic film front wall section 2B. As a result, the edge 7 and the edge 16 in the plastic film bag obtained from the blank 100 do not directly abut one another. The blank according to the present disclosure enables reliable automated large-scale production of the plastic film bag according to the present disclosure.

The features of the present disclosure disclosed in the above description, in the claims and in the drawing can be essential both individually and in any combination for the realization of the present disclosure in its various embodiments.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A plastic film bag, comprising:

a plastic film front wall with an inner and an outer face and with a first side edge and an opposite second side edge as well as an upper and an opposite lower edge and with a bag opening, spaced apart from the upper edge, with a bag opening edge, which extends between the first side edge of the plastic film front wall and the second side edge of the plastic film front wall, a plastic film rear wall with an inner and an outer face and with a first side edge and an opposite second side edge as well as an upper and an opposite lower edge, and a bag bottom, wherein the plastic film front wall and the plastic film rear wall are connected to each other between their upper edges and the bag opening edge via at least one connecting area, which extends between the first side edges of the plastic film front wall and the plastic film rear wall and the second side edges of the plastic film front wall and the plastic film rear wall, and further comprising:

at least one first adhesive area, which extends below the connecting area on the inner face of the plastic film rear wall between the first side edge of the plastic film rear wall and the second side edge of the plastic film rear wall and which has a width (A) transverse to this extension, the plastic film front wall and the plastic film rear wall each having a section which lies below the first adhesive area, wherein the plastic film front wall and the plastic film rear wall at their respective first side edges merge into one another in one piece in that section which lies below the first adhesive area, wherein the plastic film front wall and the plastic film rear wall in the region of their second side edges are bonded or welded to one another in that section which lies below the first adhesive area, wherein the one-piece transition from the plastic film front wall to the plastic film rear wall in the region of their first side edges is formed as a fold or crease, wherein the film material of the plastic film front wall and the plastic film rear wall comprises or consists of polyolefins, wherein the plastic film front wall, the bag bottom, and the plastic film rear wall are formed in one piece, wherein the plastic film front wall and the plastic film rear wall at their respective first side edges do not merge into one another or are not connected to each other in that section which lies in the region of the first adhesive area and extends up to the bag opening edge; and wherein the plastic film front wall and the plastic film rear wall at their respective second side edges do not merge into one another or are not connected to each other in that section which lies in the region of the first adhesive area and extends up to the bag opening edge, wherein the plastic film front wall in the region from the bag opening edge in the direction of the bag bottom, in which the first and second side edges of the plastic film front wall are not connected to the first and second side edges of the plastic film rear wall or do not merge into one another, forms a fold-over closure flap with a width (C), wherein the first adhesive area is present on the inner face of the plastic film rear wall in a region which can be brought into contact with the fold-over closure flap when the fold-over closure flap is folded upward away from the bag bottom toward the bag opening edge, and wherein the width (A) of the first adhesive area is smaller than or equal to the width (C) of the fold-over closure flap.

2. The plastic film bag according to claim 1, wherein:

the upper edge of the plastic film front wall and the upper edge of the plastic film rear wall form a transition from the plastic film front wall to the plastic film rear wall by way of bonding or welding, or wherein the plastic film front wall and the plastic film rear wall at their respective upper edges merge into one another; and the lower edge of the plastic film front wall and the lower edge of the plastic film rear wall in the region of the bag bottom form a transition from the plastic film front wall to the plastic film rear wall by way of bonding or welding, or wherein the plastic film front wall and the plastic film rear wall at their respective lower edges merge into one another.

3. The plastic film bag according to claim 2, wherein the transition from the plastic film front wall to the plastic film rear wall in the region of its upper edges is formed as a fold or crease and wherein the transition from the plastic film front wall to the plastic film rear wall in the region of its lower edges is formed as a fold or crease.

4. The plastic film bag according to claim 1, wherein the at least one connecting area represents a weld seam, which extends from the first side edges of the plastic film front wall and the plastic film rear wall up to the second side edges of the plastic film front wall and the plastic film rear wall.

5. The plastic film bag according to claim 1, wherein the at least one connecting area is located closer to the bag opening edge than to the upper edge of the plastic film front wall.

6. The plastic film bag according to claim 1, wherein the at least one first or second adhesive area is arranged below the bag opening edge.

7. The plastic film bag according to claim 1, further comprising:

at least one adhesive cover, configured and adapted for temporarily covering the first adhesive area.

8. The plastic film bag according to claim 1, wherein the plastic film front wall and the plastic film rear wall each have at least one substantially congruent grip hole in the section between the connecting area and the upper edges of the plastic film front wall and the plastic film rear wall.

9. The plastic film bag according to claim 1, wherein the plastic film front wall and/or plastic film rear wall comprise or consist of a single-layer or multi-layer film material.

10. The plastic film bag according to claim 1, wherein film material of the plastic film front wall and/or the plastic film rear wall is transparent.

11. The plastic film bag according to claim 1, further comprising at least one carrying element in the form of a holding loop or a holding grip.

12. The plastic film bag according to claim 1, wherein:

the plastic film front wall and the plastic film rear wall in the region of their first side edges are present welded to one another in that section which lies below the first adhesive area; and the plastic film front wall and the plastic film rear wall in the region of their second side edges are present welded to one another in that section which lies below the first adhesive area.

13. A blank for a plastic film bag according to claim 1 with mutually opposite side edges made of a single-layer or multi-layer plastic film, having:

a first plastic film front wall section;

a plastic film rear wall section adjoining this first plastic film front wall section; and a second plastic film front wall section adjoining this first plastic film front wall section, containing a bag opening edge which extends between the mutually opposite side edges, wherein the length of the plastic film rear wall section, determined along the mutually opposite side edges, is greater than or equal to the cumulative length of the first plastic film front wall section and the second plastic film front wall section.

14. The blank according to claim 13, further comprising:

in the plastic film rear wall section at least one first adhesive area, which extends between the one side edge and the opposite side edge, as well as at least one adhesive cover, configured and adapted for temporarily covering the first adhesive area.

* * * * *